US007059877B2

(12) United States Patent
Guzelderli

(10) Patent No.: US 7,059,877 B2
(45) Date of Patent: Jun. 13, 2006

(54) LATCH MECHANISM FOR ELECTRICAL CONNECTOR

(75) Inventor: Yasin Guzelderli, Brookfield, IL (US)

(73) Assignee: Clements National Company, Bedford Park, IL (US)

( * ) Notice: Subject to any disclaimer, the term of this patent is extended or adjusted under 35 U.S.C. 154(b) by 8 days.

(21) Appl. No.: 10/886,828

(22) Filed: Jul. 7, 2004

(65) Prior Publication Data

US 2006/0009056 A1 Jan. 12, 2006

(51) Int. Cl.
*H01R 13/44* (2006.01)

(52) U.S. Cl. ..... 439/142

(58) Field of Classification Search ..... 439/135, 439/142; 174/66, 67; 220/241, 242
See application file for complete search history.

(56) References Cited

U.S. PATENT DOCUMENTS 3,189,201 A * 6/1965 Day ..... 414/368
5,018,690 A * 5/1991 Widmer ..... 246/428
5,582,521 A * 12/1996 Mori et al. ..... 439/142
5,949,652 A * 9/1999 McAnally et al. ..... 361/726
5,951,309 A * 9/1999 Hopper ..... 439/142
6,038,125 A * 3/2000 Anzai ..... 361/609
6,808,401 B1 * 10/2004 Guzeldereli et al. ..... 439/160

OTHER PUBLICATIONS

U.S. Appl. No. 10/376,200, Yasin Guzeldereli.

* cited by examiner

*Primary Examiner*—James R. Harvey
(74) *Attorney, Agent, or Firm*—Dennis A. Gross; The Hill Firm

(57) ABSTRACT

An electrical connector housing of the type having a spring biased housing cover for closing the electrical connector receptacle is provided with a lever actuated latch for holding the cover in an open position against the spring force.

5 Claims, 2 Drawing Sheets

LATCH MECHANISM FOR ELECTRICAL CONNECTOR

FILED OF THE INVENTION

This invention relates to housings for electrical connectors and more particularly to connector housings having a spring biased closure cover provided with a hold-open latch.

PRIOR ART

Electrical connectors, principally large multi-pin and socket connectors, for example of the type utilized for interconnection cabling between railroad equipment such as connections between engines and cars or between cars, include receptacle housing structures attached to an interior surface of the engine or car which have portions surrounding and protecting the connector member (i.e. plug or socket). Such housings normally are provided with environmental covers to close the housing's opening and protect the connector member positioned interior thereof when the cable connector is not in use with a mating cable carried connector. Such covers may be spring biased to a closed position so that upon removal of the cable connector member the cover closes the housing providing environmental protection to the connector member positioned within the housing.

Because the interconnection cables are bulky and heavy, it is often difficult to establish a seated connection at the receptacle and it generally requires both hands and considerable force to make or unmake a secure connection. The spring biasing of the cover makes this difficult since the operator must maintain the cover in the open position in order to insert the connector member into the housing to engage the mating member within the housing.

This difficulty would be relieved if there was a mechanism for holding the cover in an opened position against the spring closure force which mechanism could be easily activated and deactivated.

SUMMARY OF THE INVENTION

This invention may incorporate a standard receptacle housing consisting generally of a backing member for attachment to a surface, such as an end wall of a railroad car, with a generally cylindrical or cylindrical recess extension which surrounds and extends outwardly defining a recess or chamber open to an interior electrical connector. In this regard the term connector or connector member can define either a male, female or compound connector component which would be received inwardly of the housing extension and connectable with a mating external connector component (i.e. a cable end). As is normal, a receptacle cover may be carried by the extension, or by the backing member, and is hingeably moveable between an open position giving direct access to the interior of the recess and a closed position closing the recess. A spring urges the cover to the closed position.

To maintain the cover in a open position a latch assembly is provided. A latch pin projects from a portion of the cover spaced from its pivot point and a spring biased latch hook is carried by the housing and is engageable with the pin when the cover is in the open position. Preferably the latch hook member has an actuating lever affixed thereto to move the latch from a pin engaged holding position to a pin disengaged position. In an embodiment of the invention the engagement of the latch can be automatic upon the opening of the cover.

It is therefore an object of this invention to provide a hold-open latch mechanism for the cover of a electrical connection housing.

It is a more specific object of this invention to provide an electrical connector housing protectively surrounding a connector member and extending beyond to define a socket or recess housing and open end face, the housing provided with a spring biased closure cover for closing the socket opening through the housing, the housing being further provided with a latch effective to hold the cover in an open position, the latch having a portion being mounted to the housing and provided with an actuating lever to move the latch between a latched and unlatched position.

In an embodiment of the invention, an electrical connector housing member is provided which has a recess area defining an opening through which a connector component is accessible. The housing hingably carries a recess closure cover which is spring biased to close the recess thereby preventing access to the connector component. A first latch member is carried by the closure cover and is moveable to a latching position upon movement of the closure cover to a recess open position of the closure cover. A complimentary second latch member is carried by the housing and is effective to engage the first latch member when the closure cover is in the opened position. The second latch member is moveable between engaged and disengaged positions. In the engaged position it will engage and hold the first latch member carried by the closure cover while in the disengaged position it will release any engagement with the first latch member freeing the closure cover. One of the latch members is spring biased to the engaged position and can be automatically engaged with the other latch member by opening the cover to the engaged position.

Other features and objects of the invention will be apparent from the description of the following preferred embodiment, although it will be understood by persons skilled in the art that the invention can be practiced in different forms utilizing different or modified components and that the following represents only one way in which this invention may be used.

DESCRIPTION OF THE PREFERRED EMBODIMENT

Figure 2:
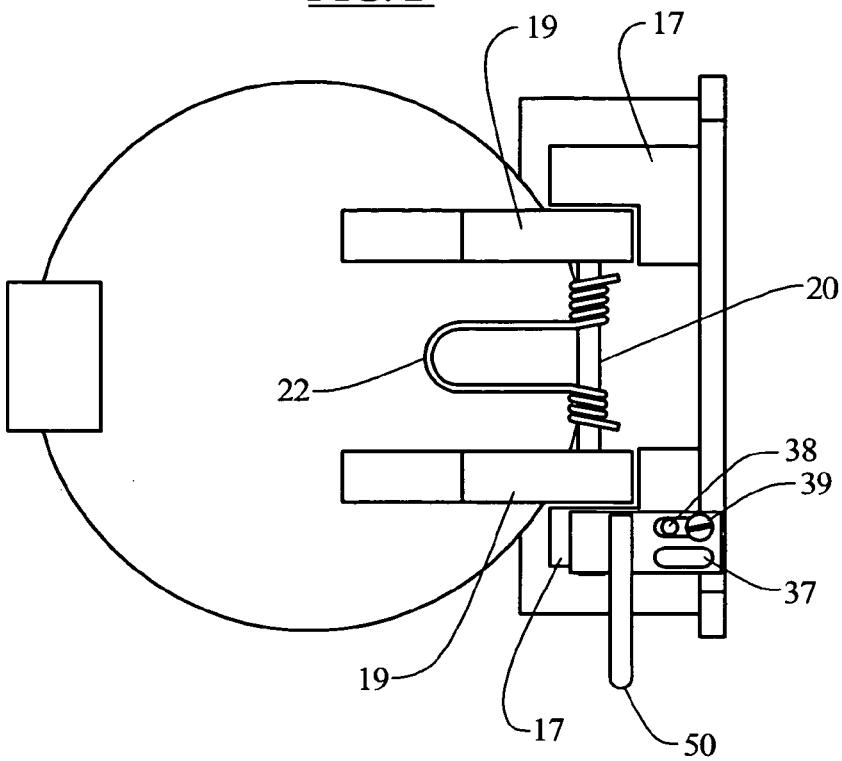
FIG. 2 is a top view of the housing of FIG. 1.
Figure 1:
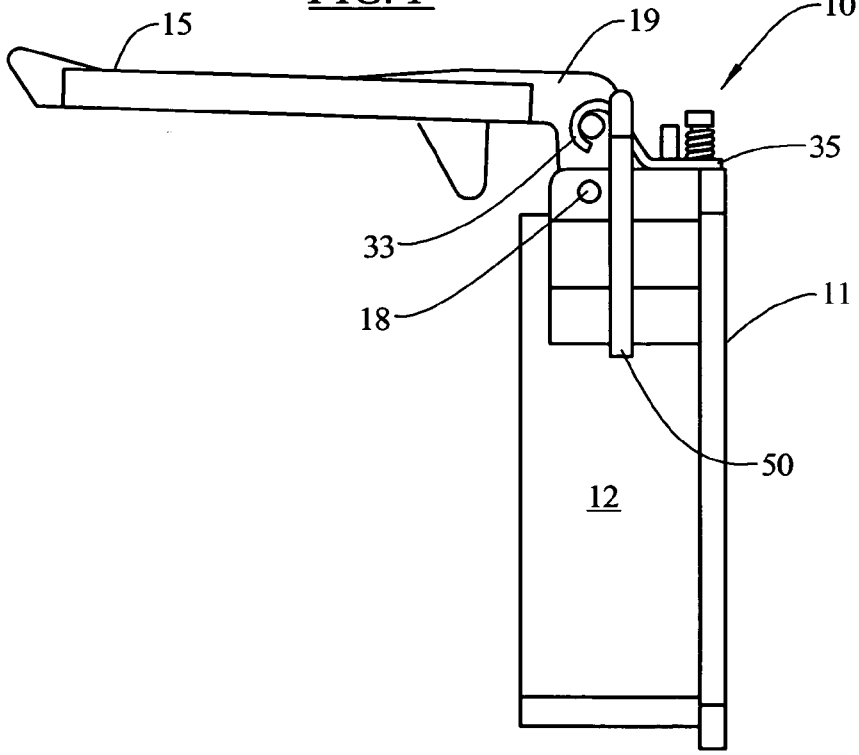
FIG. 1 is a side view of an electrical connector housing having a closure cover held in the open position by a latch mechanism.
Figure 4:
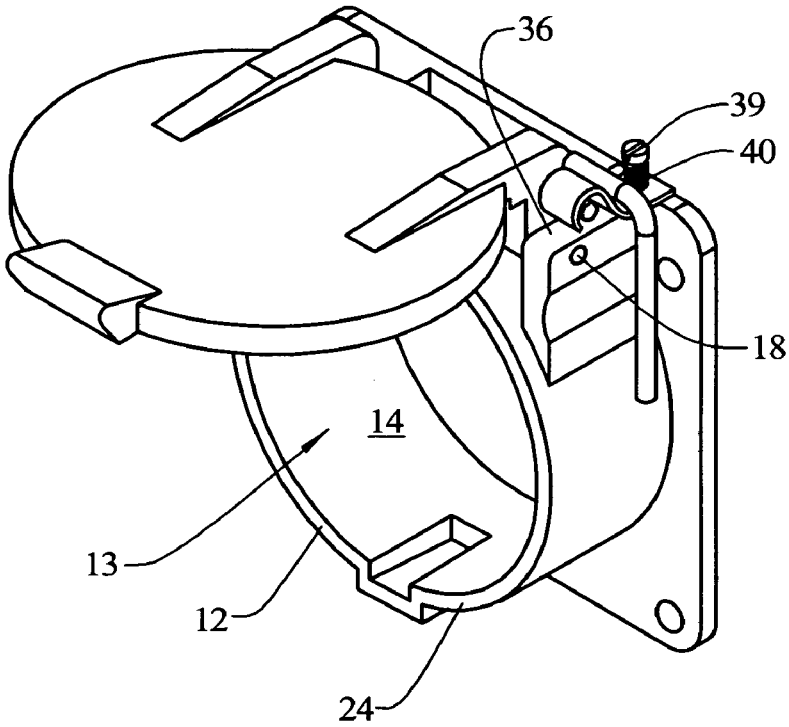
FIG. 4 is a view similar to FIG. 3 showing the fully latched cover open position.

FIG. 1 illustrates a protective electrical component housing id include a mounting plate 11 having a projecting housing member 12 which, as shown at FIG. 4, may be substantially cylindrical and hollow, defining an opening 13 to an interior compartment or recess 14 which is in turn open through the mounting plate 11. An electrical component, such as a plug or socket assembly, may be mounted within the housing and be accessible through the opening 13 and the interior 14. The housing 10 may include a cover 15 adapted to close the opening 13 and thereby provide environmental protection to the interior 14 and to the electrical component associated therewith.

Such covered housings are commonly employed where electrical outlets are otherwise exposed to the environment and are at times not connected to associated components. One particular example is in the railroad industry where connections between engines or between engines and rolling stock or between rolling stock are frequently made and broken as the train is made up and remade. A typical mating connector is shown, for example in my co-pending application Ser. No. 70/376,200.

In a standard type of housing cover, support blocks 17 extend from the housing member 12 and provide spaced-apart mountings for pivotal connections 18 to brackets 19 affixed to the cover 15. The pivotal connections may be individual pivot pins connecting individual blocks 17 to individual brackets 18 or may consist of a through pin 20 extending from one block to the other through both brackets. In that instance the through pin 20 can provide a support for a spring 22 which urges the cover to a closed position. Normally the underside of the cover will be provided with a seal member engaging the rim 24 of the cylindrical housing member 12 at the open axial end thereof.

Thus far the housing described is conventional and is merely an example of a standard variety of electrical component housings. It will be appreciated that many different designs for such housings are employed and the size, shape and construction features may be widely varied.

Common to such housings is that the cover is biased to a closed position, either by the weight of the cover itself or by an added spring such as the spring 22. Often times closing latches are provided to hold the cover in a closed position since it is desired to utilize the cover to protect the electrical component from the environment. The component whether it be a plug or socket is generally protected during use by reason of complimentary cord ended configurations which sealingly engage with the housing member 12 when the electrical components are connected together. Card ends may be provided with resilient surfaces designed to seal against the housing recess wall and/or the open end face wall. Sealing engagement, as well as the desire to have the pin and socket connections properly frictionally engaged, makes it difficult to either connect or disconnect such systems. This is particularly true when very large multi-conductor cord sets are used. Thus the connection and disconnection is often a two-handed task. The presence of a closure biased cover complicates the performance of that task.

Figure 3:
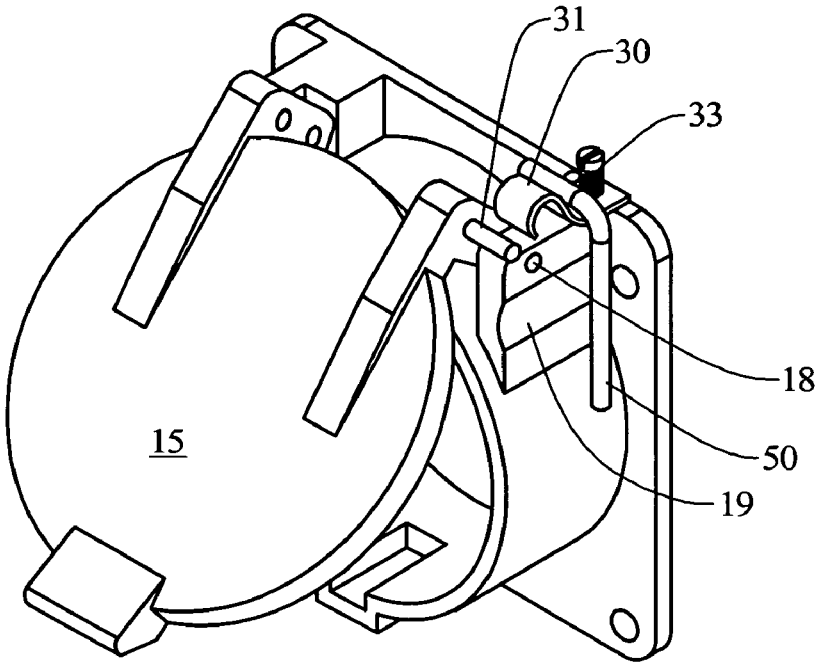
FIG. 3 is a perspective view of the electrical connector housing showing the cover latch in an unengaged position with the cover partially closed.

This invention provides a cover hold-open latch member 30 which is engageable with a projecting member 31 affixed to the cover 15, at a point spaced from the pivot 18. As shown, the projecting member 31 may be a pin affixed to and projecting from the side of one of the brackets 19. The hold-open latch member 30 may then be formed as a hook-like member having a curved end section 33 which can be slipped over the pin 31. Preferably the latch member 30 is moveably mounted to the housing and is positioned such that opening of the cover will cause the projecting member 31 to self-engage with the latch 30. In the structure illustrated, movement of the cover from the position shown in FIG. 3 from the position shown in FIG. 4 will cause the pin 31 to engage the curved end section 33 of the latch member 30 at a point adjacent its end. Further movement of the cover will then tilt the latch member 30 backwardly and upwardly along a curved movement path to open the interior of the curved section 33 to the pin 31. As the pin then snaps into place in the curved section, the latching of the cover will be completed and the cover will be held open, as shown in FIG. 1.

The curved section 33 is formed at the end of a straight section 35 which rests atop a top surface 36 of bracket 19. The straight section 35 may have one or more slots 37 therethrough which may receive a pin 38 and a shoulder screw 39 which carries a coil spring 40. The coil spring is trapped between the shoulder on the head of the shoulder screw and the top of the straight section 35. The shoulder screw is screwed into a threaded bore in the bracket 19. This structure allows the hold-open latch member 30 to move in its upward and backward opening movement against the urging of the spring 40. The pin 38 acts to stop lateral twisting of the open latch member 30.

A handle 50 may be attached to the latch in such a fashion that movement of the handle 50, for example to the left in FIG. 1 will move the latch member 30 to its unlatched open position freeing the projecting member 31 from the curved section 33 and allowing the cover to close.

It would be appreciated that the relative positions of the projecting latch member 31, the hold-open latch member 30, and the handle 50 may be modified as desired. For example, the projecting member 31 could be positioned to hold the cover in a more or less elevated position than illustrated. The latch could be more centrally located and could be mounted to the mounting plate. The handle could be formed inwardly with the latch, be welded to it or be removeably attached.

These and other modifications will be apparent to those of ordinary skill in the art although it will be appreciated that the illustrated and described preferred embodiment shows a self latching hold-open mechanism for electrical component housings provided with closure covers.

I claim as my invention:

1. An electrical connector housing member comprising a housing having an opening to an interior of the housing, a cover for closing the opening, the cover moveable between a housing opening closed position and a housing opening fully open position, a latch having a first part affixed to the cover and a second part carried by the housing, the first and second parts selectively engageable with one another at least when the cover is in the opening open position and when engaged effective to retain the cover in the opening open position with the opening open, the parts being selectively disengageable to release the cover from the opening open position, a spring biasing at least one of the parts to a position in engagement with the other paw when the cover is at the opening open position;

wherein the second part is spring biased to a latching position and is positioned to be contacted by the first part as the cover is moved from the opening closed position to the opening open position, the contact effective during movement to the opening open position to move the second part against the spring bias to allow the second part to move into a position of latched engagement with the second part;

wherein the second part has an actuating arm affixed thereto for selective movement of the second part from a latched position to an unlatched position freeing the first paw from engagement with the second paw allowing the cover to move from the opening open position.

2. A connector housing according to claim 1 wherein the cover is spring biased to the opening closed position.

3. A connector housing comprising a first portion defining a recess and a second portion defining a moveable cover for closing the recess, a latch having a first portion moveably carried by the first housing portion and a latch pin carried by the cover at a point spaced from a pivot connection of the cover to the housing first portion whereby the pin will move along a path during pivotal movement of the cover with respect to the first housing portion, the path intersecting a spring biased normal position of the first latch portion, the first latch portion having a curved hook section, further movement of the pin along the path effective to cause movement of the latch hook section to move against the spring bias to automatically couple the latch hook member to the latch pin to hold the cover in a recess open position.

4. A connector housing assembly according to claim 3 wherein a manual actuatable lever is affixed to the latch hook member for causing disengagement between the latch hook and the pin.

5. A connector housing assembly according to claim 4 wherein the second housing portion is spring biased to close the recess.

* * * * *